US009334608B2

(12) United States Patent
Ogata et al.

(10) Patent No.: US 9,334,608 B2
(45) Date of Patent: May 10, 2016

(54) POLYESTER FIBER, METHOD FOR PRODUCING THE SAME, CLOTH, TEXTILE PRODUCT, AND POLYESTER FORMED ARTICLE

(75) Inventors: Nobuaki Ogata, Osaka (JP); Akio Ukuma, Osaka (JP); Ryou Yasumitu, Osaka (JP); Kazuhiro Morishima, Ehime (JP); Tomoko Fukushima, Ehime (JP)

(73) Assignee: TEIJIN FRONTIER CO., LTD., Osaka (JP)

( * ) Notice: Subject to any disclaimer, the term of this patent is extended or adjusted under 35 U.S.C. 154(b) by 935 days.

(21) Appl. No.: 13/502,266

(22) PCT Filed: Sep. 14, 2010

(86) PCT No.: PCT/JP2010/065840

§ 371 (c)(1),
(2), (4) Date: Apr. 16, 2012

(87) PCT Pub. No.: WO2011/048888

PCT Pub. Date: Apr. 28, 2011

(65) Prior Publication Data

US 2012/0207955 A1 Aug. 16, 2012

(30) Foreign Application Priority Data

Oct. 20, 2009 (JP) ..... 2009-241464

(51) Int. Cl.
*B32B 3/00* (2006.01)
*D06M 16/00* (2006.01)
(Continued)

(52) U.S. Cl.
CPC ..... *D06M 16/00* (2013.01); *A41D 31/0077* (2013.01); *D01D 5/253* (2013.01);
(Continued)

(58) Field of Classification Search
CPC ..... D06M 16/00; D06M 2101/32; A41D 31/0077; D01F 6/84; D01F 8/14; D10B 2331/04; D10B 2401/13; D10B 2501/04; D10B 2501/043; D10B 2505/10; C08G 63/183; C08G 63/688
USPC ..... 428/172, 373, 369, 400, 401
See application file for complete search history.

(56) References Cited

U.S. PATENT DOCUMENTS 4,238,193 A * 12/1980 Kisaichi ..... D06M 14/08 525/165
4,329,389 A * 5/1982 Kimbrell, Jr. ..... D06M 15/5075 252/8.62

(Continued)

FOREIGN PATENT DOCUMENTS

CN 101080530 A 11/2007
EP 1489206 A2 * 12/2004

(Continued)

OTHER PUBLICATIONS

English translation of JP2000-119962; Tanizaki et al.; pub. date Apr. 25, 2000.*

(Continued)

*Primary Examiner* — Catherine A Simone
(74) *Attorney, Agent, or Firm* — Sughrue Mion, PLLC

(57) ABSTRACT

Disclosed are a polyester fiber having excellent antibacterial performance, deodorizing performance, and stain resistance together with sufficient durability; a method for producing the same; a cloth; a textile product; and a polyester formed article. The polyester fiber, cloth, or polyester formed article has a pH of less than 7.0 achieved by subjecting a polyester fiber, a cloth, or a polyester formed article containing a polyester copolymerized with an ester-forming metal sulfonate compound and/or an ester-forming phosphonium sulfonate compound to an acid treatment, or alternatively by applying a processing liquid having a pH of less than 7.0 to a polyester fiber, a cloth, or a polyester formed article.

26 Claims, 2 Drawing Sheets

(51) Int. Cl.

| | |
|---|---|
| ***D01D 5/253*** | (2006.01) |
| ***D01F 6/84*** | (2006.01) |
| ***D01F 8/14*** | (2006.01) |
| ***D03D 15/00*** | (2006.01) |
| ***D06M 13/188*** | (2006.01) |
| ***A41D 31/00*** | (2006.01) |
| *D06M 101/32* | (2006.01) |

(52) U.S. Cl.

CPC . *D01F 6/84* (2013.01); *D01F 8/14* (2013.01); *D03D 15/00* (2013.01); *D06M 13/188* (2013.01); *D06M 2101/32* (2013.01); *D10B 2331/04* (2013.01); *D10B 2401/13* (2013.01); *D10B 2501/04* (2013.01); *D10B 2501/043* (2013.01); *D10B 2505/10* (2013.01); *Y10T 428/1345* (2015.01); *Y10T 428/2481* (2015.01); *Y10T 428/24612* (2015.01); *Y10T 428/249921* (2015.04); *Y10T 428/2922* (2015.01); *Y10T 428/2929* (2015.01); *Y10T 428/2978* (2015.01)

(56) References Cited

U.S. PATENT DOCUMENTS

| | | | | |
|---|---|---|---|---|
| 4,557,972 | A * | 12/1985 | Okamoto et al. | 428/373 |
| 6,013,275 | A | 1/2000 | Konagaya et al. | |
| 8,240,174 | B2 | 8/2012 | Soeda | |
| 2003/0056297 | A1 * | 3/2003 | Sun | D06M 13/352 8/115.51 |
| 2004/0101684 | A1 | 5/2004 | Jen | |
| 2006/0177655 | A1 | 8/2006 | Mizohata et al. | |
| 2009/0249556 | A1 | 10/2009 | Dermeik et al. | |
| 2009/0308107 | A1 | 12/2009 | Ogata | |
| 2010/0319409 | A1 | 12/2010 | Soeda | |

FOREIGN PATENT DOCUMENTS

| | | | |
|---|---|---|---|
| EP | 1 643 019 | A1 | 4/2006 |
| JP | 58-120873 | A | 7/1983 |
| JP | 60-81367 | A | 5/1985 |
| JP | 60246873 | A | 12/1985 |
| JP | 1-192887 | A | 8/1989 |
| JP | 03-241068 | A | 10/1991 |
| JP | 4-228615 | A | 8/1992 |
| JP | 07-63438 | B | 7/1995 |
| JP | 11-335969 | A | 12/1999 |
| JP | 2000-119962 | A | 4/2000 |
| JP | 3420083 | B | 4/2003 |
| JP | 2003-247165 | A | 9/2003 |
| JP | 2004-190197 | A | 7/2004 |
| JP | 2004-211268 | A | 7/2004 |
| JP | 2004-270097 | A | 9/2004 |
| JP | 2005-200799 | A | 7/2005 |
| JP | 2005-336633 | A | 12/2005 |
| JP | 2006-233390 | A | 9/2006 |
| JP | 2006-249610 | A | 9/2006 |
| JP | 200792236 | A | 4/2007 |
| JP | 2007-169856 | A | 7/2007 |
| JP | 2008240169 | A | 10/2008 |
| JP | 2008-274277 | A | 11/2008 |
| JP | 4202361 | B2 | 12/2008 |
| JP | 2009-024278 | A | 2/2009 |
| JP | 2009-161693 | A | 7/2009 |
| JP | 2009174063 | A | 8/2009 |
| TW | I244514 | B | 12/2005 |
| WO | 97/42824 | A1 | 11/1997 |
| WO | 99/09238 | A1 | 2/1999 |
| WO | 2008/001920 | A1 | 1/2008 |
| WO | WO 2008001920 | A1 * | 1/2008 |

OTHER PUBLICATIONS

Extended European Search Report dated Sep. 10, 2013, for Application No. 10824739.6.

Partial English translation of "Hidrophilic Treatment Technology for Synthetic Fibers by Toyobo" Sen'l Gakkaishi (The Society of Fiber Science and Technology), vol. 58, No. 5 (2002), p. 139-141.

Submission of Publications submitted May 26, 2014 to the Japan Patent Office in corresponding Japanese Application No. 2011-537178.

"Sodium dimethyl 5-sulfosiophthalate on Chemical book" [online] [searched on May 21, 2014] via the Internet <http://www.chemicalbook.com/ChemicalProductProperty_JP_CB9364581.htm> (2007).

Communication dated Jul. 22, 2014 from the Japanese Patent Office in counterpart Japanese application No. 2011537178.

"Hidrophilic Treatment Technology for Synthetic Fibers by Toyobo" Sen'l Gakkaishi (The Society of Fiber Science and Technology), vol. 58, No. 5 (2002), p. 139-141.

Journal of the Textile Machinery Society of Japan, The Textile Machinery Society of Japan, vol. 56, No. 8, p. 352-356, 2003.

Journal of the Textile Machinery Society of Japan, The Textile Machinery Society of Japan, vol. 56, No. 4, p. 181-186, 2003.

* cited by examiner

FIG. 3

| | C | D | C | Miss | C | D | C | Miss | Yarn |
|---|---|---|---|---|---|---|---|---|---|
| 1 | X | Y | X | | X | | X | | A |
| 2 | | O | | | | O | | | B |
| 3 | X | Y | X | | X | | X | | A |
| 4 | | O | | | | O | | | B |
| 5 | X | Y | X | | X | | X | | A |
| 6 | | O | | | | O | | | B |
| 7 | X | Y | X | | X | | X | | A |
| 8 | | O | | | | O | | | B |
| 9 | X | | X | | X | | X | | B |
| 10 | | O | | | | O | | | A |
| 11 | X | | X | | X | | X | | B |
| 12 | | O | | | | O | | | A |
| 13 | X | | X | | X | | X | | B |
| 14 | | O | | | | O | | | A |
| 15 | X | | X | | X | | X | | B |
| 16 | | O | | | | O | | | A |

C : Cylinder
D : Dial
X : Cylinder knit
Y : Dial tuck
O : Dial knit
A : Polyethylene terephthalate false-twist crimped yarn 84T24
B : Polyethylene terephthalate false-twist crimped yarn 56T36

POLYESTER FIBER, METHOD FOR PRODUCING THE SAME, CLOTH, TEXTILE PRODUCT, AND POLYESTER FORMED ARTICLE

TECHNICAL FIELD

The present invention relates to a polyester fiber having antibacterial performance, deodorizing performance, and stain resistance; a method for producing the same; a cloth; a textile product; and a polyester formed article.

BACKGROUND ART

In the past, as antibacterial polyester fibers and antibacterial polyester formed articles, fibers and formed articles having an inorganic antibacterial agent such as silver ions or zinc ions kneaded thereinto, fibers and formed articles having a natural antibacterial agent such as chitosan or an inorganic antibacterial agent added thereto in post-processing, and the like have been proposed (see e.g., Patent Document 1, Patent Document 2, and Patent Document 3).

However, fibers and formed articles having an antibacterial agent kneaded thereinto have a problem in that such a fiber or formed article has a poor color tone. In addition, those having an antibacterial agent added thereto in post-processing have a problem with durability. Further, the use of an inorganic antibacterial agent containing silver ions, zinc ions, or the like also has environmental problems.

Meanwhile, in recent years, demands for polyester fibers and polyester formed articles with higher characteristics have been growing, and, in addition to antibacterial performance, other characteristics are also required.

Patent Document 1: JP-A-3-241068

Patent Document 2: JP-A-2004-190197

Patent Document 3: WO 97/42824

DISCLOSURE OF THE INVENTION

Problems to be Solved by the Invention

The invention was accomplished in view of the above background. An object of the invention is to provide a polyester fiber having excellent antibacterial performance, deodorizing performance, and stain resistance together with sufficient durability; a method for producing the same; a cloth; a textile product; and a polyester formed article.

Means for Solving the Problems

The present inventors conducted extensive research to achieve the above object. As a result, they surprisingly found that the acidification of a polyester fiber makes it possible to obtain a polyester fiber having, in addition to antibacterial performance, excellent deodorizing performance and stain resistance together with sufficient durability. The present inventors further conducted extensive research, and accomplished the invention.

Thus, according to the invention, "a polyester fiber containing a polyester, characterized in that the polyester fiber has a pH of less than 7.0" is provided.

It is preferable that the polyester mentioned above contains sulfur in an amount of 0.03 to 1.0 wt % based on the total weight of the polyester. It is also preferable that the polyester is a polyester copolymerized with an ester-forming metal sulfonate compound represented by the following general formula (1) and/or an ester-forming phosphonium sulfonate compound represented by the following general formula (2) in an amount of 0.1 mol % or more based on the entire acid component forming the polyester.

[Chemical Formula 1]

Formula (1)

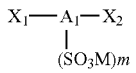

In the formula, A1 represents an aromatic group or an aliphatic group, X1 represents an ester-forming functional group, X2 represents an ester-forming functional group the same as or different from X1 or a hydrogen atom, M represents a metal, and m represents a positive integer.

[Chemical Formula 2]

Formula (2)

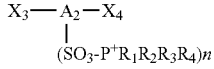

In the formula, A2 represents an aromatic group or an aliphatic group, X3 represents an ester-forming functional group, X4 represents an ester-forming functional group the same as or different from X3 or a hydrogen atom, R1, R2, R3, and R4 represent the same or different groups selected from the group consisting of alkyl and aryl groups, and n represents a positive integer.

It is also preferable that the polyester fiber has a pH of less than 7.0 after the polyester fiber is subjected to 5 washes in accordance with JIS L0217. It is also preferable that the polyester is polyethylene terephthalate, polybutylene terephthalate, polytrimethylene terephthalate, or a polyether ester. It is also preferable that the polyester has an intrinsic viscosity within a range of 0.15 to 1.5.

It is also preferable that the amount of acidic groups is within a range of 30 to 500 eq/T based on the total weight of the polyester.

In the polyester fiber of the invention, it is preferable that the polyester fiber is a core-sheath composite fiber, and the polyester is placed in the sheath of the core-sheath composite fiber. It is also preferable that the polyester fiber has a modified single-fiber cross-sectional shape. It is also preferable that the polyester fiber is a false-twist crimped yarn. It is also preferable that the polyester fiber is a multifilament having a total fineness of 10 to 200 dtex and a single-fiber fineness of 5.0 dtex or less. It is also preferable that the polyester fiber has a tensile strength of 1.0 cN/dtex or more. It is also preferable that the polyester fiber has a bacterial resistance such that after 10 washes in accordance with JIS L0217, the polyester fiber has a bacteriostatic activity value of 2.2 or more as measured in accordance with JIS L1902, a bacterial-liquid absorption method using *Staphylococcus aureus* as test bacteria. It is also preferable that the polyester fiber has a deodorizing performance of 65% or more. It is also preferable that the polyester fiber has a stain resistance of Class 3 or higher.

The invention also provides a cloth containing the above polyester fiber in an amount of 10 wt % or more based on the weight of the cloth.

It is preferable that the cloth mentioned above is a multilayer cloth having a multilayer structure. It is also preferable that the cloth has an areal weight of 50 g/m$^2$ or more. It is also preferable that the cloth has a water-repellent agent attached to at least one side thereof in a pattern that at least includes a portion where polygons are connected at their corners. It is also preferable that the cloth has projections and depressions on at least one side thereof and has a water-repellent agent attached only to projections of only one side thereof.

The invention also provides a textile product made using the above cloth. The textile product is selected from the group consisting of sportswear, outdoor wear, raincoats, umbrella cloths, men's garments, women's garments, working garments, protective garments, artificial leather, footwear, bags, curtains, waterproof sheets, tents, and car seats.

The invention also provides a method for producing the above polyester fiber. The method includes subjecting a polyester fiber to an acid treatment, the polyester fiber containing a polyester copolymerized with an ester-forming metal sulfonate compound represented by the following general formula (1) and/or an ester-forming phosphonium sulfonate compound represented by the following general formula (2).

[Chemical Formula 3]

Formula (1)

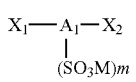

In the formula, A1 represents an aromatic group or an aliphatic group, X1 represents an ester-forming functional group, X2 represents an ester-forming functional group the same as or different from X1 or a hydrogen atom, M represents a metal, and m represents a positive integer.

[Chemical Formula 4]

Formula (2)

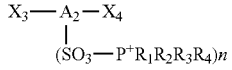

In the formula, A2 represents an aromatic group or an aliphatic group, X3 represents an ester-forming functional group, X4 represents an ester-forming functional group the same as or different from X3 or a hydrogen atom, R1, R2, R3, and R4 represent the same or different groups selected from the group consisting of alkyl and aryl groups, and n represents a positive integer.

It is preferable that the acid treatment mentioned above is performed in a treatment bath having a temperature of 70° C. or more. It is also preferable that the acid treatment is performed in a treatment bath having a pH of 5.0 or less. It is also preferable that the polyester fiber after the acid treatment has a tensile strength at least 0.1 times the tensile strength before the acid treatment. It is also preferable that the polyester fiber after the acid treatment is subjected to hydrophilization.

The invention also provides a method for producing the above polyester fiber. The method includes applying a processing liquid having a pH of less than 7.0 to a polyester fiber.

The invention also provides a polyester formed article containing a polyester. The polyester formed article is characterized in that the polyester formed article has a pH of less than 7.0.

Advantage of the Invention

The invention enables the provision of a polyester fiber having excellent antibacterial performance, deodorizing performance, and stain resistance together with sufficient durability; a method for producing the same; a cloth; a textile product; and a polyester formed article.

BRIEF DESCRIPTION OF THE DRAWINGS

FIG. 3 shows the knitting pattern employed in Example 7.

REFERENCE NUMERALS IN THE DRAWINGS

Figure 1:
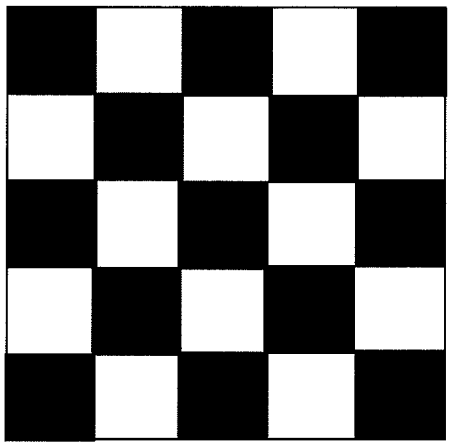
FIG. 1 schematically shows an example of a water-repellent agent attachment pattern usable in the invention (pattern in which tetragons are connected at their corners). The black part is the water-repellent region.

1 Projection
2 Depression
3 Water-repellent agent attached to projections
4 Sample

BEST MODE FOR CARRYING OUT THE INVENTION

Embodiments of the invention will be described in detail hereinafter.

The polyester fiber of the invention is a polyester fiber containing a polyester. The polyester fiber has a pH of less than 7.0 (preferably 4.0 to 6.6, more preferably 4.0 to 6.0, particularly preferably 4.0 to 5.5). The polyester fiber of the invention has a pH of less than 7.0, and thus surprisingly has excellent antibacterial performance, deodorizing performance, and stain resistance together with sufficient durability.

The measurement of pH herein is preferably performed by the following method. That is, a polyester fiber is immersed in pH 7.0 water (neutral water) at a bath ratio of 1:5 (the weight ratio between the polyester fiber and neutral water (polyester fiber:neutral water) is 1:5), and treated at a temperature of 120° C. for 30 minutes. The polyester fiber is then removed, and the pH of the residual liquid is measured with a commercially available pH meter as the pH of the polyester fiber. It is also possible to measure the pH of a polyester fiber as follows. A commercially available, universal pH paper is placed on a polyester fiber, and 0.05 to 0.10 cc of pH 7.0 water is dropped from above. Subsequently, the universal pH paper is pressed against the polyester fiber with a glass rod, and the pH is visually determined on a gray scale based on the color transferred from the universal pH paper onto the polyester fiber. Further, it is also possible to measure the pH of a polyester fiber by the method defined in JIS L 1018 6.51.

Preferred examples of polyesters for forming the polyester fiber herein include polyethylene terephthalate, polybutylene terephthalate, and polytrimethylene terephthalate. That is, it is preferable that the polyester is a polyalkylene terephthalate polyester containing terephthalic acid as a main bifunctional carboxylic acid component and ethylene glycol, trimethylene glycol, tetramethylene glycol, or the like as a main glycol component.

The polyester may also be a polyether ester containing polybutylene terephthalate as a hard segment and polyoxyethylene glycol as a soft segment or a polyether ester containing polybutylene terephthalate as a hard segment and poly (oxytetramethylene) glycol as a soft segment, such as those described in Japanese Patent No. 4202361. The polyester may also be a polyester obtained by material recycling or chemical recycling; a polyester obtained using a catalyst containing a specific phosphorus compound and a titanium compound, such as those described in JP-A-2004-270097 and JP-A-2004-211268; or polyethylene terephthalate, polylactic acid, or stereocomplex polylactic acid using a monomer component obtained from a biomass raw material, i.e., a substance of biological origin.

The polyester may also be a polyester obtained by partially substituting a terephthalic acid component with another bifunctional carboxylic acid component, and/or may also be a polyester obtained by partially substituting a glycol component with another diol compound.

Examples of bifunctional carboxylic acids other than terephthalic acid used in this case include aromatic, aliphatic, and alicyclic bifunctional carboxylic acids such as isophthalic acid, naphthalenedicarboxylic acid, diphenyldicarboxylic acid, diphenoxyethanedicarboxylic acid, β-hydroxyethoxybenzoic acid, p-oxybenzoic acid, adipic acid, sebacic acid, and 1,4-cyclohexanedicarboxylic acid.

Further, examples of diol compounds other than glycol include aliphatic, alicyclic, and aromatic diol compounds such as cyclohexane-1,4-methanol, neopentyl glycol, bisphenol A, and bisphenol S, as well as polyoxyalkylene glycols.

Further, polycarboxylic acids such as trimellitic acid and pyromellitic acid, polyols such as glycerine, trimethylolpropane, and pentaerythritol, and the like may be used as long as the polyester is substantially linear.

The polyester is synthesized by any method. In the case of polyethylene terephthalate (PET), which is a typical polyester, it is usually produced by the following reactions: a first-stage reaction in which terephthalic acid and ethylene glycol are directly subjected to an esterification reaction, dimethyl terephthalate or a like lower alkyl ester of terephthalic acid and ethylene glycol are subjected to a transesterification reaction, or terephthalic acid and ethylene oxide are subjected to a reaction, thereby producing a glycol ester of terephthalic acid and/or an oligomer thereof; and a second-stage reaction in which the reaction product of the first stage is heated under reduced pressure to undergo a polycondensation reaction until the desired degree of polymerization is reached.

It is preferable that the polyester has an intrinsic viscosity within a range of 0.15 to 1.5. When the intrinsic viscosity of the polyester is less than 0.15, the tensile strength of the polyester fiber may decrease. On the contrary, when the intrinsic viscosity of the polyester is more than 1.5, this may lead to a decrease in productivity in the production of the polyester fiber.

Further, it is preferable that the polyester contains sulfur (S) because this allows the pH of the polyester fiber to become less than 7.0 through the below-described acid treatment. In this case, it is preferable that sulfur (S) is contained in an amount of 0.03 to 1.0 wt % based on the total weight of the polyester. When the amount of sulfur contained in the polyester is less than this range, the pH of the polyester fiber may not become less than 7.0 through the below-described acid treatment. On the contrary, when the amount of sulfur contained in the polyester is more than this range, the tensile strength of the polyester fiber may decrease upon the below-described acid treatment.

As the method for adding sulfur (S) to the polyester, it is preferable to copolymerize the polyester with an ester-forming, sulfonic-acid-group-containing compound. The ester-forming, sulfonic-acid-group-containing compound does not have to be particularly limited as long as it is a sulfonic-acid-group-containing compound having an ester-forming functional group. Preferred examples thereof include an ester-forming metal sulfonate compound represented by the following general formula (1) and/or an ester-forming phosphonium sulfonate compound represented by the following general formula (2).

[Chemical Formula 5]

Formula (1)

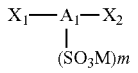

[Chemical Formula 6]

Formula (2)

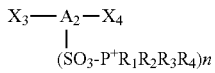

In the above general formula (1), A1 represents an aromatic group or an aliphatic group, and is preferably a $C_{6-15}$ aromatic hydrocarbon group or a $C_{10}$ or lower aliphatic hydrocarbon group. It is particularly preferable that A1 is a $C_{6-12}$ aromatic hydrocarbon group, in particular, a benzene ring. X1 represents an ester-forming functional group, and specific examples thereof include the following formula (3).

[Chemical Formula 7]

Formula (3)

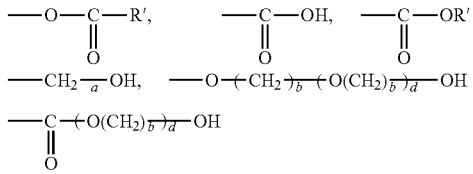

R' is a lower alkyl group or a phenyl group, a and d are an integer of 1 or more, and b is an integer of 2 or more.

In the above general formula (1), X2 represents an ester-forming functional group the same as or different from X1 or a hydrogen atom, and is particularly preferably an ester-forming functional group. M is an alkali metal or an alkaline earth metal, and m is a positive integer. It is particularly preferable that M is an alkali metal (e.g., lithium, sodium, or potassium) and m is 1.

Preferred specific examples of ester-forming metal sulfonate compounds represented by the above general formula (1) include sodium 3,5-dicarbomethoxybenzenesulfonate, potassium 3,5-dicarbomethoxybenzenesulfonate, lithium 3,5-dicarbomethoxybenzenesulfonate, sodium 3,5-dicarboxybenzenesulfonate, potassium 3,5-dicarboxybenzenesulfonate, lithium 3,5-dicarboxybenzenesulfonate, sodium 3,5-di(β-hydroxyethoxycarbonyl)benzenesulfonate, potassium 3,5-di(β-hydroxyethoxycarbonyl)benzenesulfonate, lithium 3,5-di(β-hydroxyethoxycarbonyl)benzenesulfonate, sodium 2,6-dicarbomethoxynaphthalene-4-sulfonate, potassium 2,6-dicarbomethoxynaphthalene-4-sulfonate, lithium 2,6-dicarbomethoxynaphthalene-4-sulfonate, sodium 2,6-dicarboxynaphthalene-4-sulfonate, sodium 2,6-dicarbomethoxynaphthalene-1-sulfonate, sodium 2,6-dicarbomethoxynaphthalene-3-sulfonate, sodium 2,6-dicarboxynaphthalene-4,8-disulfonate, sodium 2,6-dicarboxynaphthalene-4,8-disulfonate, sodium 2,5-bis(hydroethoxy)benzenesulfonate, and α-sodium sulfosuccinate. The ester-forming metal sulfonate compounds mentioned above may be used alone, and it is also possible to use two or more kinds together.

In the above general formula (2), A2 represents an aromatic group or an aliphatic group, and is as defined for A1 of the above general formula (1). X3 represents an ester-forming functional group, and is as defined for X1 of the above general formula (1). X4 represents an ester-forming functional group the same as or different from X3 or a hydrogen atom, and is as defined for X2 of the above general formula (1). R1, R2, R3, and R4 represent the same or different groups selected from the group consisting of alkyl and aryl groups. n is a positive integer, and particularly preferably 1.

Preferred specific examples of such ester-forming phosphonium sulfonate compounds include tetrabutylphosphonium 3,5-dicarboxybenzenesulfonate, ethyltributylphosphonium 3,5-dicarboxybenzenesulfonate, benzyltributylphosphonium 3,5-dicarboxybenzenesulfonate, phenyltributylphosphonium 3,5-dicarboxybenzenesulfonate, tetraphenylphosphonium 3,5-dicarboxybenzenesulfonate, butyltriphenylphosphonium 3,5-dicarboxybenzenesulfonate, benzyltriphenylphosphonium 3,5-dicarboxybenzenesulfonate, tetrabutylphosphonium 3,5-dicarboxybenzenesulfonate, ethyltributylphosphonium 3,5-dicarboxybenzenesulfonate, benzyltributylphosphonium 3,5-dicarboxybenzenesulfonate, phenyltributylphosphonium 3,5-dicarboxybenzenesulfonate, tetraphenylphosphonium 3,5-dicarboxybenzenesulfonate, ethyltriphenylphosphonium 3,5-dicarboxybenzenesulfonate, butyltriphenylphosphonium 3,5-dicarboxybenzenesulfonate, benzyltriphenylphosphonium 3,5-dicarboxybenzenesulfonate, tetrabutylphosphonium 3-carboxybenzenesulfonate, tetraphenylphosphonium 3-carboxybenzenesulfonate, tetrabutylphosphonium 3-carbomethybenzenesulfonate, tetraphenylphosphonium 3-carbomethybenzenesulfonate, tetrabutylphosphonium 3,5-di(β-hydroxyethoxycarbonyl)benzenesulfonate, tetraphenylphosphonium 3,5-di(β-hydroxyethoxycarbonyl) benzenesulfonate, tetrabutylphosphonium 3-(β-hydroxyethoxycarbonyl)benzenesulfonate, tetraphenylphosphonium 3-(β-hydroxyethoxycarbonyl)benzenesulfonate, tetrabutylphosphonium 4-hydroxyethoxybenzenesulfonate, tetrabutylphosphonium 2,6-dicarboxynaphthalene-4-sulfonate, and α-tetrabutylphosphonium sulfosuccinate. The ester-forming phosphonium sulfonate compounds mentioned above may be used alone, and it is also possible to use two or more kinds together.

As long as the object of the invention is not impaired, as necessary, the copolyester polymer may contain one or more kinds of micropore-forming agents, cationic dye dyeable agents, coloring inhibitors, heat stabilizers, fluorescent brighteners, delusterants, colorants, moisture absorbents, and inorganic fine particles.

In copolymerizing the ester-forming, sulfonic-acid-group-containing compound with the polyester, the compound may be added at any stage before the completion of the synthesis of the polyester, preferably at any stage before the initial stage of the second-stage reaction. In the case where two or more kinds are used together, each may be added at any stage. They may be added independently, and they may also be premixed and added simultaneously.

The polyester may also be an atmospheric pressure cation-dyeable polyester, such as one described in JP-A-2009-161693.

The fiber form of the polyester fiber is not particularly limited. However, in terms of increasing the surface area of the fiber to obtain excellent antibacterial performance and deodorizing performance, filaments (multifilament yarns) are preferable to staple fibers (spun yarns). In particular, it is preferable that the polyester fiber is a core-sheath composite fiber, where the copolyester is placed in the sheath, and polyethylene terephthalate not copolymerized with a third component, for example, is placed in the core. It is also preferable that the polyester fiber is a side-by-side composite fiber, where the copolyester is placed in one side, and polyethylene terephthalate not copolymerized with a third component, for example, is placed in the other side.

The single-fiber cross-sectional shape of the polyester fiber is not particularly limited. However, as compared with a round cross-section, modified cross-sections (i.e., cross-sections other than a round cross-section) lead to a larger single-fiber surface area and thus are preferable, examples thereof including triangular, flat, flat with three or more constrictions, round hollow, triangular hollow, quadrangular hollow, H-shaped, W-shaped, and finned cross-sections. Such a polyester fiber may also be subjected to ordinary air texturing, false-twist crimping, or twisting. In particular, in terms of increasing the bulkiness of the polyester fiber to increase the surface area of the fiber and obtain excellent antibacterial performance and deodorizing performance, it is preferable that the polyester fiber is false-twist crimped. In this case, it is preferable that the false-twist crimped yarn has a crimp degree of 1% or more. The polyester fiber may also be a low-torque composite yarn obtained by compounding a false-twist crimped yarn torqued in the direction S with a false-twist crimped yarn torqued in the direction Z, as described in WO 2008/001920.

In addition, with respect to the single-fiber fineness of the polyester fiber and the number of filaments therein, in terms of increasing the surface area of the fiber to obtain excellent antibacterial performance and deodorizing performance, a lower single-fiber fineness is more desirable, while a larger number of filaments is more desirable. The single-fiber fineness is preferably 5.0 dtex or less (more preferably 0.0001 to 2.5 dtex, still more preferably 0.001 to 1.5 dtex). The number of filaments is preferably 30 to 50000 (more preferably 30 to 200). In addition, the ultrafine fiber described in JP-B-7-63438 and the microfiber described in JP-A-2009-024278 are also possible. In terms of obtaining excellent texture, it is preferable that the polyester fiber has a total fineness (single-fiber fineness×the number of filaments) of 10 to 200 dtex.

The polyester fiber of the invention can be produced by the following production method, for example. That is, a polyester fiber containing the polyester copolymerized with an ester-forming metal sulfonate compound and/or an ester-forming phosphonium sulfonate compound is subjected to an acid treatment. According to this method, ionic moieties in the ester-forming metal sulfonate compound and/or ester-forming phosphonium sulfonate compound are protonated, whereby the polyester fiber is acidified.

The method for subjecting a polyester fiber to an acid treatment may be such that, for example, the polyester fiber is immersed in a bath with the pH adjusted to 5.0 or less with acetic acid, malic acid, or the like (preferably 2.0 to 5.0) at a temperature of 70° C. or more (preferably 80 to 130° C., particularly preferably 90 to 130° C.) for 20 to 40 minutes. At that time, the polyester fiber may be immersed in the bath in the form of a yarn. It is also possible to obtain a cloth using the polyester fiber, and then immerse the cloth in the bath. In addition, the equipment used may be a known jet dyeing machine.

Here, in the polyester fiber after the acid treatment, it is preferable that the amount of acidic groups is 30 to 500 eq/T (more preferably 50 to 300 eq/T) based on the total weight of the polyester in the fiber. The amount of acidic groups is the amount measured by decomposing a polyester with benzyl alcohol and then titrating the decomposition product with an aqueous sodium hydroxide solution using a microburet.

When the amount of acidic groups is less than 50 eq/T, it may be impossible for the polyester fiber of the invention to sufficiently exhibit sufficient deodorizing performance, antibacterial performance, and stain resistance. On the contrary, when the amount of acidic groups is more than 500 eq/T, sufficient strength may not be maintained. This is impossible, and thus is undesirable.

Before and/or after the acid treatment, the polyester fiber may also be subjected to dyeing, degumming, relaxation, pre-setting, final setting, or various processes in the usual manner. Further, it is also possible to additionally apply napping, water-repellent processing, calendering, UV shielding, or other various processes for imparting the functions of an antistatic agent, an antibacterial agent, a deodorant, an insect repellant, a phosphorescent agent, a retroreflective agent, a minus ion generator, etc.

In particular, it is preferable that the polyester fiber is hydrophilized (sweat-absorbing processing) after the acid treatment because this provides even better antibacterial performance, deodorizing performance, and stain resistance.

Here, as hydrophilization, it is preferable that a hydrophilizing agent such as PEG diacrylate, a derivative thereof, or a polyethylene terephthalate-polyethylene glycol copolymer is attached in an amount of 0.25 to 0.50 wt % based on the weight of the cloth at the time of dyeing in the same bath, for example.

The thus-obtained polyester fiber has excellent antibacterial performance, deodorizing performance, and stain resistance together with sufficient durability. Its mechanism has not yet been sufficiently clarified, but is presumably that the acidification of the polyester fiber reduces bacteria or odor components.

In the thus-obtained polyester fiber, it is preferable that the polyester fiber after the acid treatment has a tensile strength of 1.0 cN/dtex or more (more preferably 1.5 to 6.0 cN/dtex). It is preferable that the tensile strength is at least 0.1 times (more preferably 0.4 to 1 time, particularly preferably 0.5 to 1 time) the tensile strength of the polyester fiber before the acid treatment. In order for the polyester fiber after the acid treatment to have a tensile strength of 1.0 cN/dtex or more, the intrinsic viscosity of the polyester or the sulfur content of the polyester may be adjusted.

It is preferable that the polyester fiber after the acid treatment has a degree of protonation of 10% or more (more preferably 20 to 50%).

The degree of protonation is to be determined using the following equation:

$$\text{Degree of Protonation } (\%)=(A-B)/A\times 100$$

wherein A is the functional group concentration measured from the polyester fiber by X-ray fluorescence spectrometry, and B is the metal ion concentration measured from the polyester fiber by raw-yarn absorption spectrometry.

In addition, as another production method for adjusting the pH of the polyester fiber to less than 7.0, it is possible to apply a processing liquid having a pH of less than 7.0 (preferably 5.0 or less, particularly preferably 2.0 to 5.0) to a polyester fiber.

In this case, it is preferable that the polyester fiber is a polyester fiber made of polyethylene terephthalate. In addition, it is preferable that the processing liquid having a pH of less than 7.0 contains an acidic compound having a sulfonic acid group or a carboxylic acid group. In this case, preferred specific examples of acidic compounds include vinyl sulfonate monomers and vinyl carboxylate monomers.

Here, the processing liquid may be applied to the polyester fiber in the form of a yarn. It is also possible to obtain a cloth using the polyester fiber, and then apply the processing liquid to the cloth. In addition, as a method for applying a processing liquid, a known padding method is preferable.

Incidentally, it is preferable that the processing liquid also contains a compound having a hydrophilic group (e.g., a polyethylene terephthalate-polyethylene glycol copolymer, etc.) because this not only further improves antibacterial performance, deodorizing performance, and stain resistance, but also imparts moisture absorbency and antistatic properties to the polyester fiber. Further, it is also preferable that the processing liquid contains a binder resin.

The thus-obtained polyester fiber of the invention has a pH of less than 7.0, and thus has excellent antibacterial performance, deodorizing performance, and stain resistance together with sufficient durability. It is preferable that the polyester fiber has a bacterial resistance such that after 10 washes in accordance with JIS L0217, the polyester fiber has a bacteriostatic activity value of 2.2 or more as measured in accordance with JIS L1902, a bacterial-liquid absorption method (test bacteria: *Staphylococcus aureus*). It is also preferable that after 10 washes in accordance with JIS L0217, the polyester fiber has a bactericidal activity value of 0 or more as measured in accordance with JIS L1902, a bacterial-liquid absorption method (test bacteria: *Staphylococcus aureus*). It is also preferable that the polyester fiber has a deodorizing performance of 65% or more.

With respect to deodorizing performance, a 10 cm×10 cm square sample is placed in a Tedlar bag containing 3 L of air containing ammonia at an initial concentration of 100 ppm. The malodorous component concentration in the Tedlar bag after 2 hours is measured with a detector tube manufactured by Gastec Corporation, and odor adsorption is calculated from the decrement.

It is also preferable that the polyester fiber has a stain resistance of Class 3 or higher.

Stain resistance is measured by the stain release test defined in JIS L1919C (using lipophilic contaminant 3).

The polyester cloth of the invention is a cloth made using the polyester fiber mentioned above. It is preferable that the cloth contains the polyester fiber in an amount of 10 wt % or more (more preferably 40 wt % or more, most preferably 100 wt %) based on the weight of the cloth.

The cloth is made using the polyester fiber mentioned above. Therefore, the cloth is acidified. It is preferable that the cloth has a pH of less than 7.0 (preferably 4.0 to 6.6, more preferably 4.0 to 6.0, particularly preferably 4.0 to 5.5). When the pH of the cloth is less than 7.0, the cloth has excellent antibacterial performance, deodorizing performance, and stain resistance together with sufficient durability. It is preferable that the cloth has a bacterial resistance such that after 10 washes in accordance with JIS L0217, the cloth has a bacteriostatic activity value of 2.2 or more as measured in accordance with JIS L1902, a bacterial-liquid absorption method (test bacteria: *Staphylococcus aureus*). It is also preferable that after 10 washes in accordance with JIS L0217, the cloth has a bactericidal activity value of 0 or more as measured in accordance with JIS L1902, a bacterial-liquid absorption method (test bacteria: *Staphylococcus aureus*). It is also preferable that the cloth has a deodorizing performance of 65% or more as measured by the above method. It is also preferable that the cloth has a stain resistance of Class 3 or higher as measured by the above method.

The measurement of pH herein is preferably performed by the following method. That is, a cloth is immersed in pH 7.0 water (neutral water) at a bath ratio of 1:5 (the weight ratio between the cloth and neutral water (cloth:neutral water) is 1:5), and treated at a temperature of 120° C. for 30 minutes.

The cloth is then removed, and the pH of the residual liquid is measured with a commercially available pH meter as the pH of the cloth. It is also possible to measure the pH of a cloth as follows. A commercially available, universal pH paper is placed on a cloth, and 0.05 to 0.10 cc of pH 7.0 water is dropped from above. Subsequently, the universal pH paper is pressed against the cloth with a glass rod, and the pH is visually determined on a gray scale based on the color transferred from the universal pH paper onto the cloth. Further, it is also possible to measure the pH of a cloth by the method defined in JIS L 1018 6.51.

Further, the structure of the cloth is not particularly limited, and it may be a woven fabric, a knitted fabric, or a nonwoven fabric. For example, examples of weave structures for woven fabrics include three foundation weaves including plain, twill, and satin; modifications thereof; modifications such as modified twill; single-backed double weaves such as warp-backed and weft-backed weaves; warp pile weaves such as warp velvet, towels, and velour; and weft pile weaves such as velveteen, weft velvet, velvet, and corduroy. Incidentally, a woven fabric having such a weave structure can be woven by an ordinary method using an ordinary weaving machine such as a rapier loom or an air-jet weaving machine. The number of layers is not particularly limited either, and it may be a monolayer woven fabric or may also be a multilayer woven fabric including two or more layers.

A knitted fabric may be a weft-knitted fabric or a warp-knitted fabric. Preferred examples of weft-knitting structures include plain stitch, rib stitch, interlock stitch, purl stitch, tuck stitch, float stitch, half cardigan stitch, lace stitch, and pile stitch. Preferred examples of warp-knitting structures include single denbigh stitch, single atlas stitch, double cord stitch, half tricot stitch, fleece stitch, and jacquard stitch. Incidentally, knitting may be performed by an ordinary method using an ordinary knitting machine such as a circular knitting machine, a flat knitting machine, a tricot machine, or a raschel machine. The number of layers is not particularly limited either, and it may be a monolayer knitted fabric or may also be a multilayer knitted fabric including two or more layers.

In the cloth mentioned above, it is also preferable that the cloth is a multilayer woven or knitted fabric including two or more layers, in which the single-fiber fineness or density of the constituent fibers vary between layers, thereby enhancing water absorption by capillarity. It is also preferable that the cloth has a multilayer structure, in which the polyester fiber is placed in the layer that is on the skin side (back) when used.

With respect to the areal weight of the cloth, a greater areal weight is more desirable in terms of obtaining excellent antibacterial performance and deodorizing performance, and it is preferably 50 g/m$^2$ or more (more preferably 100 to 250 g/m$^2$).

In the case where the cloth is a woven fabric, in terms of obtaining excellent antibacterial performance and deodorizing performance, it is preferable that the warp cover factor and the weft cover factor are both 500 to 5000 (still more preferably 500 to 2500). Incidentally, cover factors CF as used herein are represented by the following formula.

$$\text{Warp cover factor } CF_p=(DWp/1.1)^{1/2}\times MWp$$

$$\text{Weft cover factor } CF_f=(DWf/1.1)^{1/2}\times MWf$$

[$DW_p$ is the warp total fineness (dtex), $MW_p$ is the warp weaving density (yarns/2.54 cm), $DW_f$ is the weft total fineness (dtex), and $MW_f$ is the weft weaving density (yarns/2.54 cm).]

In the cloth, as described in JP-A-2005-336633, it is preferable that the cloth has a water-repellent agent attached to at least one side thereof in a pattern that at least includes a portion where polygons are connected at their corners; this provides a cloth that not only has excellent bacterial resistance, deodorizing performance, and stain resistance, but also has less wetness.

Here, the water-repellent agent may be attached to both sides of the cloth, but is preferably attached to only one side. In the case where it is attached to only one side, and such a side is the back of the cloth (i.e., the side closer to the human'skin when the cloth is used as a garment), upon sweating, sweat is quickly absorbed and diffused to the outdoor-air side. As a result, quick-drying properties are also obtained. The attachment of the water-repellent agent to only one side is also preferable for the reason that soft texture is unlikely to be impaired. Incidentally, it is preferable that the degree of penetration of the water-repellent agent into the cloth in the thickness direction is ½ or less (more preferably ⅕ or less) the thickness from the surface to which the water-repellent agent has been applied.

The pattern that at least includes a portion where polygons are connected at their corners means a pattern that has an area in which a polygon is in contact with another polygon at its corner as schematically shown in FIG. 1, where the polygons are tetragons. When polygons are connected in the warp and weft directions at their corners in this manner, water such as sweat passes through a non-water-repellent region that is in the form of islands, and diffuses in the thickness direction. As a result, almost no water remains on the side having a water-repellent agent applied thereto, whereby wetness is reduced. At the same time, because polygons are in point contact with one another at their corners, there is no risk of impairing soft texture.

Here, as the polygon, a tetragon or triangle is preferable. With respect to the size of the polygon, it is preferable that the length of one side of the polygon is within a range of 0.5 to 2.0 mm (more preferably 0.7 to 1.5 mm). When the length is less than 0.5 mm or otherwise more than 2.0 mm, water-absorbing properties may deteriorate, whereby wetness cannot be sufficiently reduced.

In the water-repellent agent attachment pattern, the area percentage of the application region is preferably within a range of 30 to 85% (more preferably 40 to 70%). When the area percentage of the application region is less than 30%, at the time of water absorption, water may spread in the plane direction, whereby wetness cannot be sufficiently reduced. On the contrary, when the area percentage of the application region is more than 85%, not only that water-absorbing properties may deteriorate, but also that the soft texture may be impaired.

The area percentage of the application region is represented by the following equation.

$$\text{Area Percentage of Application Region (\%)}=(\text{Area of Application Region})/((\text{Area of Application Region})+(\text{Area of Non-Application Region}))\times 100$$

Incidentally, it is necessary that the pattern at least has an area in which where a polygon is connected to another polygon at its corner, and it is preferable that 30% or more (preferably 50%) of all the polygons are connected to other polygons at their corners. In addition, it is necessary that each polygon has a substantially polygonal shape, and it is acceptable that a polygonal has a curved side.

In addition, in the cloth, as described in JP-A-2006-249610, it is preferable that the cloth has projections and depressions on at least one side thereof and has a water-repellent agent attached only to projections of only one side thereof; this provides a cloth that not only has excellent bacterial resistance, deodorizing performance, and stain resistance, but also has less wetness.

Here, with respect to the structure of the cloth, the cloth may have projections and depressions on only one side thereof, with the other side being flat. Alternatively, the cloth may also have projections and depressions on both sides thereof. Further, the cloth may also be an ordinary mesh cloth having openings.

When a water-repellent agent is attached only to projections of only one side, and the cloth is used as a garment with such a side being the skin side, upon sweating, sweat either passes through depressions of that side (openings in the case where the cloth is a mesh cloth) and is absorbed by the other side or easily falls from the projections having the water-repellent agent attached thereto. As a result, wetness is not felt. At the same time, because the water-repellent agent is attached only locally, the soft texture of the woven or knitted fabric is not impaired.

The following describes specific embodiments of the cloth that has projections and depressions on at least one side thereof and has a water-repellent agent attached only to projections of only one side thereof.

First, according to a first embodiment, the cloth is a mesh cloth. The cloth has a water-repellent agent attached only to one side thereof and has no water-repellent agent attached to the other side. The mesh cloth herein may be an ordinary mesh cloth, in which the percentage of through-openings extending in the thickness direction is 2 to 95% (more preferably 20 to 60%) relative to the surface area of the cloth. In this case, it is preferable that the degree of penetration of the water-repellent agent into the cloth in the thickness direction is ½ or less (more preferably ⅕ or less) the thickness from the surface to which the water-repellent agent has been applied.

Figure 2:
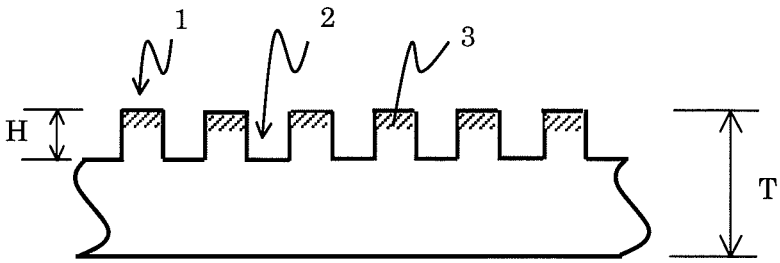
FIG. 2 schematically shows the attachment of a water-repellent agent to projections in the invention.

Next, according to a second embodiment, the cloth is a waffle-like knitted fabric. The knitted fabric has a water-repellent agent attached only to projections of one side thereof. A waffle-like knitted fabric is, for example, a knitted fabric formed according to the knitting pattern shown in FIG. 3 of JP-A-2006-249610, which is a knitted fabric having projections and depressions on only one side or both sides thereof. Here, it is preferable that the water-repellent agent is attached only to projections of one side as schematically shown in FIG. 2.

Next, a third embodiment is a woven or knitted fabric that is a double ripple knitted fabric. The knitted fabric has a water-repellent agent attached only to projections of one side thereof. A double ripple knitted fabric is, for example, a knitted fabric formed according to the knitting pattern shown in FIG. 2 of Japanese Patent No. 3420083, which is a knitted fabric having projections and depressions on only one side or both sides thereof. Here, it is preferable that the water-repellent agent is attached only to projections of one side.

Next, a forth embodiment is a woven or knitted fabric that is a weft-backed woven fabric. The woven fabric has a water-repellent agent attached only to projections of one side thereof. A weft-backed woven fabric is, for example, a woven fabric formed according to the weaving pattern shown in FIG. 1 of Japanese Patent No. 3420083, which is a woven fabric having projections and depressions on only one side or both sides thereof. Here, it is preferable that the water-repellent agent is attached only to projections of one side.

Examples of methods for producing the cloth of the invention are: a method in which a cloth is knitted or woven using polyester fibers containing the polyester mentioned above copolymerized with an ester-forming metal sulfonate compound and/or an ester-forming phosphonium sulfonate compound, and then the cloth is subjected to the acid treatment mentioned above; a method in which a cloth is knitted or woven using polyester fibers such as polyethylene terephthalate fibers, and then the processing liquid mentioned above having a pH of less than 7.0 (preferably 5.0 or less, particularly preferably 2.0 to 5.0) is applied to the cloth; etc.

Next, the textile product of the invention is a textile product made using the above cloth and selected from the group consisting of sportswear, outdoor wear, raincoats, umbrella cloths, men's garments, women's garments, working garments, protective garments, artificial leather, footwear, bags, curtains, waterproof sheets, tents, and car seats. Because of the use of the cloth, such a textile product has excellent antibacterial performance, deodorizing performance, and stain resistance together with sufficient durability.

The reason why the polyester fiber, cloth, and textile product of the invention have excellent antibacterial performance, deodorizing performance, and stain resistance together with sufficient durability has not yet been clarified, but is presumably that the acidification of the polyester fiber inhibits the proliferation of bacteria.

Next, the formed article of the invention is a polyester formed article containing a polyester. The polyester formed article has a pH of less than 7.0 (preferably 4.0 to 6.6, more preferably 4.0 to 6.0, particularly preferably 4.0 to 5.5). The polyester formed article of the invention has a pH of less than 7.0, and thus surprisingly has excellent antibacterial performance, deodorizing performance, and stain resistance together with sufficient durability.

The measurement of pH herein is preferably performed by the following method. That is, a polyester formed article is immersed in pH 7.0 water (neutral water) at a bath ratio of 1:5 (the weight ratio between the polyester formed article and neutral water (polyester formed article:neutral water) is 1:5), and treated at a temperature of 120° C. for 30 minutes. The polyester formed article is then removed, and the pH of the residual liquid is measured with a commercially available pH meter as the pH of the polyester formed article. It is also possible to measure the pH of a polyester formed article as follows. A commercially available, universal pH paper is placed on a polyester formed article, and 0.05 to 0.10 cc of pH 7.0 water is dropped from above. Subsequently, the universal pH paper is pressed against the polyester formed article with a glass rod, and the pH is visually determined on a gray scale based on the color transferred from the universal pH paper onto the polyester formed article. Further, it is also possible to measure the pH of a polyester formed article by the method defined in JIS L 1018 6.51.

As a method for achieving a polyester formed article having a pH of less than 7.0, it is possible to obtain a polyester formed article using the polyester mentioned above copolymerized with an ester-forming metal sulfonate compound and/or an ester-forming phosphonium sulfonate compound, and then subject the polyester formed article to an acid treatment. Alternatively, it is also possible to apply a processing liquid having a pH of less than 7.0 to a polyester formed article.

Formed articles of the invention include articles formed by injection molding, extrusion, vacuum forming, pressure forming, blow molding, etc. Specific examples thereof include pellets, fibers, fiber structures that are composites of fibers with other materials, films, sheets, and three-dimensional structures. Examples of applications of such formed articles include beverage bottle products, film materials for displays (liquid crystal, plasma, OEL), cards (IC cards, ID cards, RFID, etc.), film materials for automobiles (interior/exterior decor, electronic parts), film-laminated cans for beverages and foods, shrink-packaging materials, retort pouches, materials for environment-responsive plastic trays, films for applications to semiconductors/medical materials/photocatalysts, cosmetic face masks, touch panels, membrane switches, electrical/electronic parts such as various housings, toothed wheels, and gears, architectural materials, civil engineering materials, agricultural materials, automobile parts (interior/exterior parts, etc.), and parts for daily use.

EXAMPLES

Hereinafter, the invention will be described in detail with reference to examples and comparative examples. However, the invention is not limited thereto in anyway. Measured values are values determined by the following methods.

(1) Amount of Sulfur (S) (wt %)

5 gr of polyester fibers were melted on a heated hot plate to form a flat plate. Subsequently, using an X-ray fluorescence spectrometer ZSX100e manufactured by Rigaku Corporation, the quantity of sulfur atoms in the formed plate was determined by an X-ray fluorescence method.

(2) pH of Polyester Fiber (Cloth)

A sample was immersed in pH 7.0 water (neutral water) at a bath ratio of 1:5 (the weight ratio between the sample and neutral water (sample:neutral water)=1:5), and treated at a temperature of 120° C. for 30 minutes. The sample was then removed, and the pH of the residual liquid was measured with a commercially available pH meter (manufactured by Atago Co., Ltd., Model DPH-2) as the pH of the polyester fiber (cloth). Incidentally, measurement was performed before washing (L0) and after 5 washes in accordance with JIS L0217 (L5).

(3) Degree of Protonation

The degree of protonation was calculated by the following equation:

$$\text{Degree of Protonation (\%)}=(A-B)/A\times 100$$

wherein A is the functional group concentration measured from a polyester fiber by X-ray fluorescence spectrometry, and B is the metal ion concentration measured from a polyester fiber by raw-yarn absorption spectrometry.

(4) Amount of Acidic Groups (eq/T)

A polyester fiber after an acid treatment was decomposed with benzyl alcohol, and the decomposition product was titrated with a 0.02N aqueous sodium hydroxide solution using phenol red as an indicator to determine the number of equivalents per ton.

(5) Intrinsic Viscosity

A polyester fiber after an acid treatment was dissolved in orthochlorophenol at 100° C. for 60 minutes, and the resulting dilution was subjected to measurement at 35° C. using a Ubbelohde viscometer. Intrinsic viscosity was determined from the measured value.

(6) Areal Weight of Cloth

The areal weight (g/m$^2$) of a cloth was measured in accordance with JIS L 1096.

(7) Antibacterial Performance of Polyester Fiber (Cloth)

A sample was subjected to 10 washes in accordance with JIS L0217 (L10), and then the bacteriostatic activity value and bactericidal activity value were measured in accordance with JIS L1902, a bacterial-liquid absorption method (test bacteria: *Staphylococcus aureus*). A bacteriostatic activity value of 2.2 or more was rated as acceptable (Good), and a value of less than 2.2 was rated as unacceptable (Poor). Meanwhile, a bactericidal activity value of 0 or more was rated as acceptable (Good), and a value of less than 0 was rated as unacceptable (Poor).

(8) Deodorizing Performance of Polyester Fiber (Cloth)

A 10 cm×10 cm square sample was placed in a Tedlar bag containing 3 L of air containing ammonia at an initial concentration of 100 ppm. The malodorous component concentration in the Tedlar bag after 2 hours was measured with a detector tube manufactured by Gastec Corporation, and odor adsorption was calculated from the decrement as in the following equation.

Odor Adsorption (%)=(Initial Malodorous Component Concentration−Malodorous Component Concentration after 2 Hours)/(Initial Malodorous Component Concentration)×100

(9) Stain Resistance of Polyester Fiber (Cloth)

Stain resistance was measured by the stain release test defined in JIS L1919C (using lipophilic contaminant 3).

(10) Crimp Degree

A test yarn was wound around a sizing reel having a perimeter of 1.125 m to prepare a skein having a dry fineness of 3333 dtex. The skein is hung on a hanger nail of a scale plate. An initial load of 6 g is applied to the lower part thereof, and a further load of 600 g is applied; the skein length at that time is measured as L0. The load is then immediately removed from the skein, and the skein is removed from the hanger nail of the scale plate and immersed in boiling water for 30 minutes, allowing crimps to be developed. The skein treated with boiling water is taken out from boiling water, and moisture contained in the skein is removed by absorption on a filter paper. The skein is then air-dried for 24 hours at room temperature. The air-dried skein is hung on a hanger nail of a scale plate. A load of 600 g is applied to the lower part thereof, and the skein length is measured after 1 minute as L1a. The load is then removed from the skein, and the skein length is measured after 1 minute as L2a. The crimp degree (CP) of the test filament yarn was calculated by the following equation.

$$CP(\%)=((L1a-L2a)/L0)\times 100$$

(11) Tensile Strength and Tensile Strength Retention of Polyester Fiber

The tensile strength of a polyester fiber after an acid treatment was measured by the method defined in JIS L1013 7.5. Further, the tensile strength retention of a polyester fiber after an acid treatment was calculated by the following equation.

Tensile Strength Retention=(Tensile Strength of Polyester Fiber after Acid Treatment)/(Tensile Strength of Polyester Fiber before Acid Treatment)

(12) Wetness

First, 0.3 cc of water was placed on an acrylic plate. A woven or knitted fabric cut into a 10 cm square was placed thereon, and, while applying a load of 2.9 mN/cm$^2$ (0.3 gf/cm$^2$), the woven or knitted fabric was allowed to suffiently absorb water for 30 seconds. After that, the water-soaked woven or knitted fabric was placed on the upper arms of ten panelists, including five men and five women, and the sensory evaluation of wetness was performed. In the evaluation, wetness was evaluated on a four-level scale: extremely low (the best), low, middle, high. Incidentally, the amount of water, 0.3 ml, placed on the acrylic plate was enough to run over the entire 10-cm square cloth.

(13) Water-Absorbing Properties

Measurement was performed in accordance with the test method of JIS L-1018A (falling-drop method), related to the rate of water absorption. The time for one drop of water on a horizontal sample surface to be absorbed was shown.

Example 1

Using a spinneret having a discharge hole with a triangular cross-section, polyethylene terephthalate, which had been copolymerized with 5-sodium sulfoisophthalic acid as an ester-reactive, sulfonic-acid-group-containing compound in an amount of 1.5 mol % based on the entire acid component forming the polyethylene terephthalate, was spun and stretched in the usual manner, and then subjected to known false-twist crimping to give a polyethylene terephthalate false-twist crimped yarn having a crimp degree of 13% (total fineness: 84 dtex/72 fil, single-fiber cross-sectional shape: triangular cross-section).

Subsequently, using a 28G circular knitting machine, only the polyethylene terephthalate false-twist crimped yarn (total fineness: 84 dtex/72 fil, single-fiber cross-sectional shape: triangular cross-section) was knitted into a knitted fabric having the structure of an interlock circular knitted fabric.

Subsequently, the knitted fabric was immersed in a bath with the pH adjusted to 4.8 with acetic acid at a temperature of 130° C. for 30 minutes, and thereby acid-treated.

Subsequently, the knitted fabric was subjected to a dyeing-finishing process in the usual manner, in which a sweat absorption treatment is performed in a bath during dyeing. At that time, a hydrophilizing agent (a polyethylene terephthalate-polyethylene glycol copolymer) was attached to the knitted fabric in a bath in an amount of 0.30 wt % relative to the weight of the knitted fabric to perform the sweat absorption treatment.

The obtained knitted fabric had an areal weight of 200 g/m$^2$. As shown in Table 1, with the appropriate degree of protonation, the knitted fabric (cloth) had a low pH even after 5 washes (acidified) and also had excellent antibacterial performance, deodorizing performance, and stain resistance.

Subsequently, sportswear (T-shirt) was produced using the knitted fabric and worn. As a result, the sportswear had excellent antibacterial performance, deodorizing performance, and stain resistance. Evaluation results are shown in Table 1.

Example 2

Using a spinneret having a discharge hole with a round cross-section, polyethylene terephthalate, which had been copolymerized with 5-sodium sulfoisophthalic acid as an ester-reactive, sulfonic-acid-group-containing compound in an amount of 2.5 mol % based on the entire acid component forming the polyethylene terephthalate, was spun and stretched in the usual manner, and then subjected to known false-twist crimping to give a polyethylene terephthalate false-twist crimped yarn having a crimp degree of 15% (total fineness: 84 dtex/36 fil, single-fiber cross-sectional shape: round cross-section).

Subsequently, using a 28G circular knitting machine, 50 wt % of the polyethylene terephthalate false-twist crimped yarn (total fineness: 84 dtex/36 fil) and 50 wt % of an ordinary polyethylene terephthalate (polyethylene terephthalate not copolymerized with a third component) false-twist crimped yarn (total fineness: 84 dtex/72 fil) were combined and knitted into a knitted fabric having the structure of an interlock circular knitted fabric.

Subsequently, the knitted fabric was immersed in a bath with the pH adjusted to 4.5 with acetic acid at a temperature of 130° C. for 30 minutes, and thereby acid-treated.

Subsequently, the knitted fabric was subjected to a dyeing-finishing process in the usual manner, in which a sweat absorption treatment is performed in a bath during dyeing. At that time, a hydrophilizing agent (a polyethylene terephthalate-polyethylene glycol copolymer) was attached to the knitted fabric in a bath in an amount of 0.30 wt % relative to the weight of the knitted fabric to perform the sweat absorption treatment.

The obtained knitted fabric had an areal weight of 210 g/m$^2$. As shown in Table 1, with the appropriate degree of protonation, the knitted fabric (cloth) had a low pH even after 5 washes (acidified) and also had excellent antibacterial performance, deodorizing performance, and stain resistance. Evaluation results are shown in Table 1.

Example 3

Using a spinneret having a discharge hole with a round cross-section, polyethylene terephthalate, which had been copolymerized with 5-tetra-n-butylphosphonium sulfoisophthalic acid in an amount of 4.0 mol % based on the entire acid component forming the polyethylene terephthalate, was spun and stretched in the usual manner, and then subjected to known false-twist crimping to give a polyethylene terephthalate false-twist crimped yarn having a crimp degree of 8% (total fineness: 167 dtex/144 fil, single-fiber cross-sectional shape: round cross-section).

Subsequently, using a 28G circular knitting machine, 50 wt % of the polyethylene terephthalate false-twist crimped yarn (total fineness: 167 dtex/144 fil) and 50 wt % of an ordinary polyethylene terephthalate (polyethylene terephthalate not copolymerized with a third component) false-twist crimped yarn (total fineness: 167 dtex/144 fil) were combined and knitted into a knitted fabric having the structure of an interlock circular knitted fabric.

Subsequently, the knitted fabric was immersed in a bath with the pH adjusted to 4.3 with acetic acid at a temperature of 130° C. for 30 minutes, and thereby acid-treated.

Subsequently, the knitted fabric was subjected to a dyeing-finishing process in the usual manner, in which a sweat absorption treatment is performed in a bath during dyeing. At that time, a hydrophilizing agent (a polyethylene terephthalate-polyethylene glycol copolymer) was attached to the knitted fabric in a bath in an amount of 0.30 wt % relative to the weight of the knitted fabric to perform the sweat absorption treatment.

The obtained knitted fabric had an areal weight of 150 g/m$^2$. As shown in Table 1, with the appropriate degree of protonation, the knitted fabric (cloth) had a low pH even after 5 washes (acidified) and also had excellent antibacterial performance, deodorizing performance, and stain resistance. Evaluation results are shown in Table 1.

Example 4

Using polyethylene terephthalate, which had been copolymerized with 5-tetra-n-butylphosphonium sulfoisophthalic acid in an amount of 4.5 mol % based on the entire acid component forming the polyethylene terephthalate, for the sheath (part S), while using ordinary polyethylene terephthalate (polyethylene terephthalate not copolymerized with a third component) for the core (part C), they were spun in a weight ratio of 7:3 and stretched to give a core-sheath composite fiber having a round cross-section. The composite fiber was then subjected to known false-twist crimping to give a polyethylene terephthalate false-twist crimped yarn having a crimp degree of 3% (total fineness: 84 dtex/72 fil).

Subsequently, using a 28G circular knitting machine, only the polyethylene terephthalate false-twist crimped yarn was knitted into a knitted fabric having the structure of an interlock circular knitted fabric.

Subsequently, the knitted fabric was immersed in a bath with the pH adjusted to 3.8 with acetic acid at a temperature of 130° C. for 30 minutes, and thereby acid-treated.

Subsequently, the knitted fabric was subjected to a dyeing-finishing process in the usual manner, in which a sweat absorption treatment is performed in a bath during dyeing. At that time, a hydrophilizing agent (a polyethylene terephthalate-polyethylene glycol copolymer) was attached to the knitted fabric in a bath in an amount of 0.30 wt % relative to the weight of the knitted fabric to perform the sweat absorption treatment.

The obtained knitted fabric had an areal weight of 150 g/m$^2$. As shown in Table 1, with the appropriate degree of protonation, the knitted fabric (cloth) had a low pH even after 5 washes (acidified) and also had excellent antibacterial performance, deodorizing performance, and stain resistance. Evaluation results are shown in Table 1.

Example 5

Polyethylene terephthalate, which had been copolymerized with 5-sodium sulfoisophthalic acid as an ester-reactive, sulfonic-acid-group-containing compound in an amount of 2.5 mol % based on the entire acid component forming the polyethylene terephthalate, was spun and stretched in the usual manner to give a yarn having a round cross-section. The yarn was then subjected to known false-twist crimping to give a polyethylene terephthalate false-twist crimped yarn having a crimp degree of 15% (total fineness: 84 dtex/36 fil).

Subsequently, using 40 wt % of the polyethylene terephthalate false-twist crimped yarn (total fineness: 84 dtex/36 fil) for the back of a knitted fabric and 60 wt % of an ordinary polyethylene terephthalate (polyethylene terephthalate not copolymerized with a third component) false-twist crimped yarn (total fineness: 84 dtex/72 fil) for the front, they were knitted into a knitted fabric having the structure of a combined, single-side knotted, circular knitted fabric using a 28G circular knitting machine.

Subsequently, the knitted fabric was immersed in a bath with the pH adjusted to 4.5 with acetic acid at a temperature of 130° C. for 30 minutes, and thereby acid-treated.

Subsequently, the knitted fabric was subjected to a dyeing-finishing process in the usual manner, in which a sweat absorption treatment is performed in a bath during dyeing. At that time, a hydrophilizing agent (a polyethylene terephthalate-polyethylene glycol copolymer) was attached to the knitted fabric in a bath in an amount of 0.30 wt % relative to the weight of the knitted fabric to perform the sweat absorption treatment.

The obtained knitted fabric had an areal weight of 250 g/m$^2$. As shown in Table 1, with the appropriate degree of protonation, the knitted fabric (cloth) had a low pH even after 5 washes (acidified) and also had excellent antibacterial performance, deodorizing performance, and stain resistance. Evaluation results are shown in Table 1.

TABLE 1

| | | Example 1 | Example 2 | Example 3 | Example 4 | Example 5 |
|---|---|---|---|---|---|---|
| Type of Yarn | Name | SD84T72 DTY | SD84T36 DTY | SD167T144 DTY | SD84T72 DTY S/C Conj. yarn | SD84T36 DTY |
| | Organic Salt Content | 1.5 mol % | 2.5 mol % | 4.0 mol % | S: 4.5 mol C: REG (0 mol) | 2.5 mol % |
| | Crimp Degree | 13.0% | 15.0% | 8.0% | 3.0% | 15.0% |
| | Yarn Cross-Section | Triangular | Round | Round | Round | Round |
| | Yarn Proportion | 100% | 50% | 50% | 100% | 40% |
| Type of Knitted Fabric | Type of Weaving/Knitting, Gauge | 28G, Interlock | 28G, Interlock | 28G, Interlock | 28G, Interlock | 28G, One-side knotted |
| | Areal Weight (g/m$^2$) | 200 | 210 | 150 | 200 | 250 |
| Processing | Treatment in Bath | Sweat absorption | Sweat absorption | Sweat absorption | Sweat absorption | Sweat absorption |
| | Presence of Acid Treatment | Treated | Treated | Treated | Treated | Treated |
| | Treatment Liquid PH | 4.8 | 4.5 | 4.3 | 3.8 | 4.5 |
| Physical Properties | Amount of Sulfur wt % | 0.29 | 0.48 | 0.76 | 0.43 | 0.48 |
| | Amount of Acidic Groups | 166 | 258 | 396 | 235 | 258 |
| | Intrinsic Viscosity | 0.38 | 0.35 | 0.20 | 0.36 | 0.36 |
| | Tensile Strength cN/dtex | 1.9 | 1.7 | 0.6 | 3.0 | 1.5 |
| | Tensile Strength Retention | 0.50 | 0.45 | 0.15 | 0.80 | 0.40 |
| | pH of L0 | 6.5 | 6.0 | 6.0 | 5.5 | 6.5 |
| | pH of L5 | 6.5 | 6.5 | 6.0 | 6.0 | 6.5 |
| | Degree of Protonation (in terms of raw yarn %) | 25 | 28 | 35.5 | 12 | 20 |
| | Antibacterial Performance (L10) | Acceptable | Acceptable | Acceptable | Acceptable | Acceptable |
| | (Bacteriostatic Activity Value) | 2.2 or more | 2.2 or more | 2.2 or more | 2.2 or more | 2.2 or more |
| | Antibacterial Performance (L10) | Acceptable | Acceptable | Acceptable | Acceptable | Acceptable |
| | (Bactericidal Activity Value) | 0 or more | 0 or more | 0 or more | 0 or more | 0 or more |
| | Ammonia Deodorizing Performance | 95% | 93% | 92% | 98% | 85% |
| | Stain Resistance | 3-4 | 4 | 4 | 4 | 3 |

Comparative Example 1

The same procedure as in Example 1 was performed except no acid treatment was performed. The obtained knitted fabric had an areal weight of 200 g/m$^2$. As shown in Table 2, the knitted fabric was neutral (pH=7.0 in both L5 and L0), and its antibacterial performance, deodorizing performance, and stain resistance were all insufficient. Evaluation results are shown in Table 2.

Comparative Example 2

The same procedure as in Example 2 was performed, except that only an ordinary polyethylene terephthalate (polyethylene terephthalate not copolymerized with a third component) false-twist crimped yarn (total fineness: 84 dtex/72 fil) was knitted into a knitted fabric having the structure of an interlock circular knitted fabric.

The obtained knitted fabric had an areal weight of 200 g/m$^2$. As shown in Table 2, the knitted fabric was neutral (pH=7.0 in both L5 and L0), and its antibacterial performance, deodorizing performance, and stain resistance were all insufficient. Evaluation results are shown in Table 2.

TABLE 2

| | | Comparative Example 1 | Comparative Example 2 |
|---|---|---|---|
| Type of Yarn | Name | SD84T72 DTY | SD84T72 DTY |
| | Organic Salt Content | 1.5 mol % | Not contained |
| | Crimp Degree | 13.0% | 18.0% |
| | Yarn Cross-Section | Triangular | Round |
| | Yarn Proportion | 100% | 100% |
| Type of Knitted Fabric | Gauge | 28G, Interlock | 28G, Interlock |
| | Areal Weight (g/m$^2$) | 200 | 200 |
| Processing | Treatment in Bath | Sweat absorption | Sweat absorption |
| | Presence of Acid Treatment | Not treated | Treated |
| | Treatment Liquid PH | — | 4.0 |
| Physical Properties | pH of L0 | 7.0 | 7.0 |
| | pH of L5 | 7.5 | 7.5 |
| | Degree of Protonation (in terms of raw yarn %) | 0 | 0 |
| | Antibacterial Performance (L10) (Bacteriostatic Activity Value) | Unacceptable 0.5 | Unacceptable 0.1 |
| | Antibacterial Performance (L10) (Bactericidal Activity Value) | Unacceptable −2.1 | Unacceptable −1.5 |
| | Ammonia Deodorizing Performance | 55% | 50% |
| | Stain Resistance | 1-2 | 2 |

Example 6

Onto one side of the knitted fabric obtained in Example 1, a treatment liquid of the following formulation was applied in an amount of about 15 g/m$^2$ by gravure transfer printing in the checkerboard grid pattern shown in FIG. 1 (square size: 1 mm×1 mm, area percentage of the application region: 50%), then dried at 120° C., and subjected to a dry heat treatment at 160° C. for 45 seconds.

[Composition of Treatment Liquid]

Water: 91.6 wt %

Fluoride-based water-repellent agent: 8 wt %

("AsahiGuard AG710" manufactured by Asahi Glass)

Melamine-based binder resin: 0.3 wt %

("SUMITEX Resin M-3" manufactured by Sumitomo Chemical, contact angle: 67.5°

Catalyst: 0.1 wt %

(SUMITEX Accelerator ACX)

The obtained knitted fabric was as follows: wetness: low, water-absorbing properties: 0.4 seconds, texture: soft.

Example 7

Using a spinneret having a discharge hole with a round cross-section, polyethylene terephthalate, which had been copolymerized with 5-sodium sulfoisophthalic acid as an ester-reactive, sulfonic-acid-group-containing compound in an amount of 1.5 mol % based on the entire acid component forming the polyethylene terephthalate, was spun and stretched in the usual manner, and then subjected to known false-twist crimping to give a false-twist crimped yarn A having a crimp degree of 13% (total fineness: 84 dtex/24 fil, single-fiber cross-sectional shape: round cross-section).

Further, using a spinneret having a discharge hole with a round cross-section, polyethylene terephthalate, which had been copolymerized with 5-sodium sulfoisophthalic acid as an ester-reactive, sulfonic-acid-group-containing compound in an amount of 1.5 mol % based on the entire acid component forming the polyethylene terephthalate, was spun and stretched in the usual manner, and then subjected to known false-twist crimping to give a false-twist crimped yarn B having a crimp degree of 13% (total fineness: 56 dtex/36 fil, single-fiber cross-sectional shape: round cross-section).

Subsequently, using a 24G circular knitting machine, the false-twist crimped yarn A and the false-twist crimped yarn B were knitted into a knitted fabric having the structure of a waffle-like knitted fabric shown in FIG. 3 (grey fabric density: 30 courses/2.54 cm, 30 wales/2.54 cm).

Subsequently, the knitted fabric was immersed in a bath with the pH adjusted to 4.8 with acetic acid at a temperature of 130° C. for 30 minutes, and thereby acid-treated.

Subsequently, the knitted fabric was subjected to a dyeing-finishing process in the usual manner, in which a sweat absorption treatment is performed in a bath during dyeing. At that time, a hydrophilizing agent (a polyethylene terephthalate-polyethylene glycol copolymer) was attached to the knitted fabric in a bath in an amount of 0.30 wt % relative to the weight of the knitted fabric to perform the sweat absorption treatment, followed by drying and setting.

Subsequently, onto one side of the knitted fabric, a treatment liquid of the following formulation was applied in an amount of about 20 g/m$^2$ only to projections by gravure transfer printing, then dried at 135° C., and subjected to a dry heat treatment at 160° C. for 45 seconds.

[Composition of Treatment Liquid]

Water: 91.6 wt %

Fluoride-based water-repellent agent: 8 wt %

("AsahiGuard AG710" manufactured by Asahi Glass)

Melamine-based binder resin: 0.3 wt %

("SUMITEX Resin M-3" manufactured by Sumitomo Chemical, contact angle: 67.5°

Catalyst: 0.1 wt %

(SUMITEX Accelerator ACX)

The obtained knitted fabric was as follows: height of projections: 0.3 mm, water-absorbing properties: less than 1 second.

Example 8

Using a spinneret having a discharge hole with a round cross-section, polyethylene terephthalate was spun and stretched in the usual manner, and then subjected to known false-twist crimping to give a polyethylene terephthalate false-twist crimped yarn having a crimp degree of 15% (total fineness: 84 dtex/36 fil, single-fiber cross-sectional shape: round cross-section).

Subsequently, using a 28G circular knitting machine, the polyethylene terephthalate false-twist crimped yarn (total fineness: 84 dtex/36 fil) was knitted into a knitted fabric having the structure of an interlock circular knitted fabric. The knitted fabric was then subjected to dyeing in the usual manner.

Subsequently, the knitted fabric was subjected to a padding treatment using a processing liquid of the following formulation (pH 4.0), dried at a temperature of 110° C. for 1 minute, and then steam-treated (at a temperature of 100° C. for 10 minutes).

Vinyl sulfonate monomer: 1 wt %

Vinyl carboxylate monomer: 0.5 wt %

Ethylene glycol monomer: 1 wt %

Catalyst: 0.5 wt %

Water: 97 wt %

The obtained knitted fabric had an areal weight of 200 g/m$^2$. The pH of the knitted fabric (cloth) was 6.5 both in the cases of L0 and L5. In addition, the bacteriostatic activity value was 2.2 or more (acceptable), and the bactericidal activity value was 0 or more (acceptable). In addition, the ammonia deodorizing performance was 80%, and the texture was good.

Subsequently, sportswear (T-shirt) was produced using the knitted fabric and worn. As a result, the sportswear had excellent antibacterial performance, deodorizing performance, and stain resistance.

INDUSTRIAL APPLICABILITY

The invention provides a polyester fiber having excellent antibacterial performance, deodorizing performance, and stain resistance together with sufficient durability; a method for producing the same; a cloth; a textile product; and a polyester formed article. The industrial value thereof is extremely high.

The invention claimed is:

1. A polyester fiber comprising a polyester, characterized in that the polyester fiber has a pH of 4.0 to 6.6 and the polyester fiber is hydrophilized and a single-fiber fineness of the polyester fiber is 0.001 to 1.5 dtex and the polyester fiber contains a polyester copolymerized with an ester-forming metal sulfonate compound represented by the following general formula (1) and/or an ester-forming phosphonium sulfonate compound represented by the following general formula (2):

Formula (1)

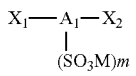

wherein A1 represents an aromatic group or an aliphatic group, X1 represents an ester-forming functional group, X2 represents an ester-forming functional group the same as or different from X1 or a hydrogen atom, M represents a metal, and m represents a positive integer;

Formula (2)

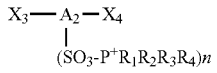

wherein A2 represents an aromatic group or an aliphatic group, X3 represents an ester-forming functional group, X4 represents an ester-forming functional group the same as or different from X3 or a hydrogen atom, R1, R2, R3, and R4 represent the same or different groups selected from the group consisting of alkyl and aryl groups, and n represents a positive integer.

2. A polyester fiber according to claim 1, wherein the polyester contains sulfur in an amount of 0.03 to 1.0 wt % based on the total weight of the polyester.

3. A polyester fiber according to claim 1, wherein the polyester fiber has a pH of less than 7.0 after the polyester fiber is subjected to 5 washes in accordance with JIS L0217.

4. A polyester fiber according to claim 1, wherein the polyester is polyethylene terephthalate, polybutylene terephthalate, polytrimethylene terephthalate, or a polyether ester.

5. A polyester fiber according to claim 1, wherein the polyester has an intrinsic viscosity within a range of 0.15 to 1.5.

6. A polyester fiber according to claim 1, wherein an amount of acidic groups is within a range of 30 to 500 eq/T based on the total weight of the polyester.

7. A polyester fiber according to claim 1, wherein the polyester fiber is a core-sheath composite fiber, and the polyester is placed in the sheath of the core-sheath composite fiber.

8. A polyester fiber according to claim 1, wherein the polyester fiber has a modified single-fiber cross-sectional shape.

9. A polyester fiber according to claim 1, wherein the polyester fiber is a false-twist crimped yarn.

10. A polyester fiber according to claim 1, wherein the polyester fiber is a multifilament having a total fineness of 10 to 200 dtex.

11. A polyester fiber according to claim 1, wherein the polyester fiber has a tensile strength of 1.0 cN/dtex or more.

12. A polyester fiber according to claim 1, wherein the polyester fiber has a bacterial resistance such that after 10 washes in accordance with JIS L0217, the polyester fiber has a bacteriostatic activity value of 2.2 or more as measured in accordance with JIS L1902, a bacterial-liquid absorption method using *Staphylococcus aureus* as test bacteria.

13. A polyester fiber according to claim 1, wherein the polyester fiber has a deodorizing performance of 65% or more.

14. A polyester fiber according to claim 1, wherein the polyester fiber has a stain resistance of Class 3 or higher.

15. A cloth comprising a polyester fiber according to claim 1 in an amount of 10 wt % or more based on the weight of the cloth.

16. A cloth according to claim 15, wherein the cloth is a multilayer cloth having a multilayer structure.

17. A cloth according to claim 15, wherein the cloth has an areal weight of 50 g/m$^2$ or more.

18. A cloth according to claim 15, wherein the cloth has a water-repellent agent attached to at least one side thereof in a pattern that at least includes a portion where polygons are connected at their corners.

19. A cloth according to claim 15, wherein the cloth has projections and depressions on at least one side thereof and has a water-repellent agent attached only to projections of only one side thereof.

20. A textile product made using a cloth according to claim 15, the textile product being selected from the group consisting of sportswear, outdoor wear, raincoats, umbrella cloths, men's garments, women's garments, working garments, protective garments, artificial leather, footwear, bags, curtains, waterproof sheets, tents, and car seats.

21. A method for producing a polyester fiber according to claim 1, comprising subjecting a polyester fiber to an acid treatment, the polyester fiber containing a polyester copolymerized with an ester-forming metal sulfonate compound represented by the following general formula (1) and/or an ester-forming phosphonium sulfonate compound represented by the following general formula (2):

Formula (1)

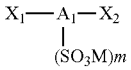

wherein A1 represents an aromatic group or an aliphatic group, X1 represents an ester-forming functional group, X2 represents an ester-forming functional group the same as or different from X1 or a hydrogen atom, M represents a metal, and m represents a positive integer;

Formula (2)

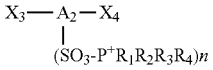

wherein A2 represents an aromatic group or an aliphatic group, X3 represents an ester-forming functional group, X4 represents an ester-forming functional group the same as or different from X3 or a hydrogen atom, R1, R2, R3, and R4 represent the same or different groups selected from the group consisting of alkyl and aryl groups, and n represents a positive integer.

22. A method for producing a polyester fiber according to claim 21, wherein the acid treatment is performed in a treatment bath having a temperature of 70° C. or more.

23. A method for producing a polyester fiber according to claim 21, wherein the acid treatment is performed in a treatment bath having a pH of 5.0 or less.

24. A method for producing a polyester fiber according to claim 21, wherein the polyester fiber after the acid treatment has a tensile strength at least 0.1 times the tensile strength before the acid treatment.

25. A method for producing a polyester fiber according to claim 21, wherein the polyester fiber after the acid treatment is subjected to hydrophilization.

26. A method for producing a polyester fiber according to claim 1, comprising applying a processing liquid having a pH of less than 7.0 to a polyester fiber.

* * * * *